US007559280B2

(12) United States Patent
Kalantari

(10) Patent No.: US 7,559,280 B2
(45) Date of Patent: Jul. 14, 2009

(54) ADJUSTABLE LINK SYSTEM

(75) Inventor: Amir M. Kalantari, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 346 days.

(21) Appl. No.: 11/500,681

(22) Filed: Aug. 8, 2006

(65) Prior Publication Data

US 2007/0261227 A1 Nov. 15, 2007

Related U.S. Application Data

(60) Provisional application No. 60/796,248, filed on Apr. 28, 2006.

(51) Int. Cl.
*B61B 3/00* (2006.01)
*F16H 29/20* (2006.01)

(52) U.S. Cl. ..... 104/89; 74/89.11

(58) Field of Classification Search ..... 104/89, 104/90, 91, 88.01; 74/89.23, 89.11, 89.12, 74/89.14

See application file for complete search history.

(56) References Cited

U.S. PATENT DOCUMENTS

| | | | | |
|---|---|---|---|---|
| 2,212,695 | A | | 8/1940 | Nash |
| 2,660,027 | A | | 11/1953 | Geyer |
| 2,902,945 | A | | 9/1959 | Simon |
| 2,988,012 | A | | 6/1961 | Markley et al. |
| 3,132,598 | A | | 5/1964 | Pearson |
| 3,135,497 | A | | 6/1964 | Beck |
| 3,150,820 | A | | 9/1964 | Jekat et al. |
| 3,313,014 | A | | 4/1967 | Lemelson |
| 3,561,365 | A | | 2/1971 | Rooklyn |
| 3,927,760 | A | | 12/1975 | McCall |
| 4,000,664 | A | | 1/1977 | Christensen |
| 4,069,764 | A | | 1/1978 | Teyssedre |
| 4,395,180 | A | * | 7/1983 | Magnotte ..... 414/282 |
| 4,821,217 | A | | 4/1989 | Jackson et al. |
| 5,119,732 | A | | 6/1992 | Lisy |
| 5,174,167 | A | | 12/1992 | Hill et al. |
| 5,236,395 | A | * | 8/1993 | Lucich et al. ..... 474/69 |
| 5,321,874 | A | | 6/1994 | Mills et al. |
| 5,445,045 | A | * | 8/1995 | Nagai et al. ..... 74/490.09 |
| 5,698,959 | A | * | 12/1997 | Yanagisawa ..... 318/568.11 |
| 6,745,454 | B1 | | 6/2004 | Grimshaw et al. |

* cited by examiner

*Primary Examiner*—S. Joseph Morano
*Assistant Examiner*—Robert J McCarry, Jr.
(74) *Attorney, Agent, or Firm*—Kinney & Lange, P.A.

(57) ABSTRACT

An adjustable link assembly includes an elongate frame member having a first connection structure at an upper end thereof, a threaded drive shaft, a motor operably connected to the threaded drive shaft to enable rotation of the threaded drive shaft, a slide block operatively engaged in a sliding relationship with the frame member and operatively engaged in a driving relationship with the threaded drive shaft, and a lower frame member having a base portion and two leg portions extending from the base portion pivotally connected to the slide block and having a second connection structure at a lower end thereof. The threaded drive shaft is rotatably connected to the frame member at first and second ends of the threaded drive shaft. Rotation of the threaded drive shaft drives sliding movement of the slide block with respect to the frame member.

20 Claims, 3 Drawing Sheets

ADJUSTABLE LINK SYSTEM

CROSS-REFERENCE TO RELATED APPLICATION(S)

This application claims priority from U.S. Provisional Patent Application Ser. No. 60/796,248, filed Apr. 28, 2006, for ADJUSTABLE LINK SYSTEM AND MULTIPURPOSE ENGINE SUPPORT/BUILD BEAM by Amir Kalantari, which is herein incorporated by reference in its entirety.

BACKGROUND OF THE INVENTION

The present invention relates to adjustable supports.

During the assembly of gas turbine engines, it is common to conduct assembly operations along an engine pack line, which resembles an assembly line. First, engine modules are built and placed on pedestals. The engine modules are then lifted into position for attachment to an engine core by cable hoists and pulleys suspended from an overhead track. As assembly operations progress, the partially assembled engine and its modules require a great deal of pick-up and moving operations with the hoists and pulleys. The pedestals can get in the way of workers. In short, these operations are time consuming and present safety issues. A key safety issue is the presence of large (about 7,257 kg or 16,000 lbs.) loads suspended from cable hoists and pulleys using hooks. These arrangements pose risks to workers around or under the engine, who can be hurt if the engine, or a part of it, falls from the cable or the cable hoist and pulley system fails.

It is desired to provide an alternative support system for use in gas turbine engine assembly that does not require loads to be suspended from cable hoists and pulleys.

BRIEF SUMMARY OF THE INVENTION

An adjustable link assembly according to the present invention includes an elongate frame member having a first connection structure at an upper end thereof, a threaded drive shaft, a motor operably connected to the threaded drive shaft to enable rotation of the threaded drive shaft, a slide block operatively engaged in a sliding relationship with the frame member and operatively engaged in a driving relationship with the threaded drive shaft, and a lower frame member having a base portion and two leg portions extending from the base portion pivotally connected to the slide block and having a second connection structure at a lower end thereof. The threaded drive shaft is rotatably connected to the frame member at first and second ends of the threaded drive shaft. Rotation of the threaded drive shaft drives sliding movement of the slide block with respect to the frame member.

DETAILED DESCRIPTION

Figure 1:
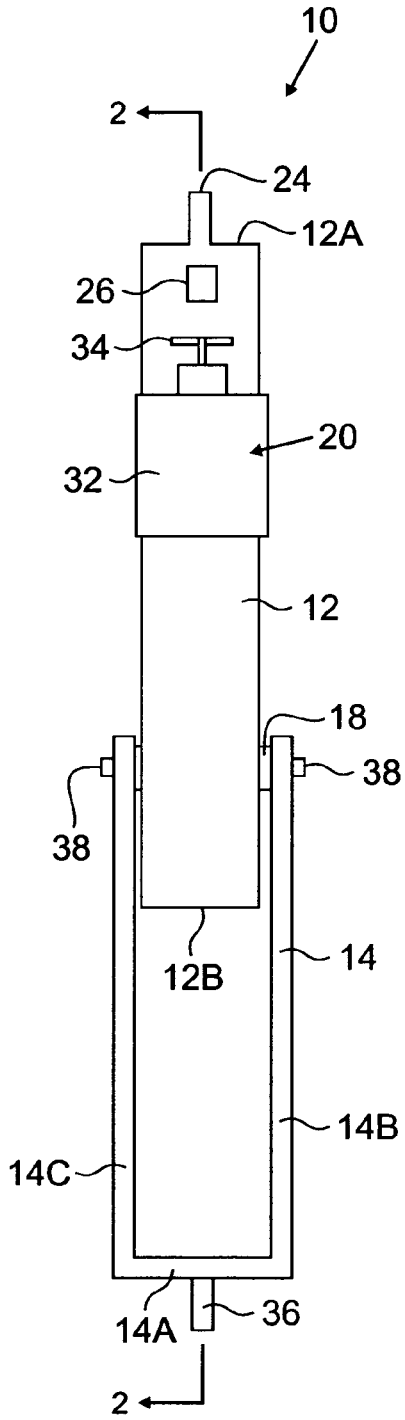
FIG. 1 is a side view of an adjustable link assembly according to the present invention.
Figure 2:
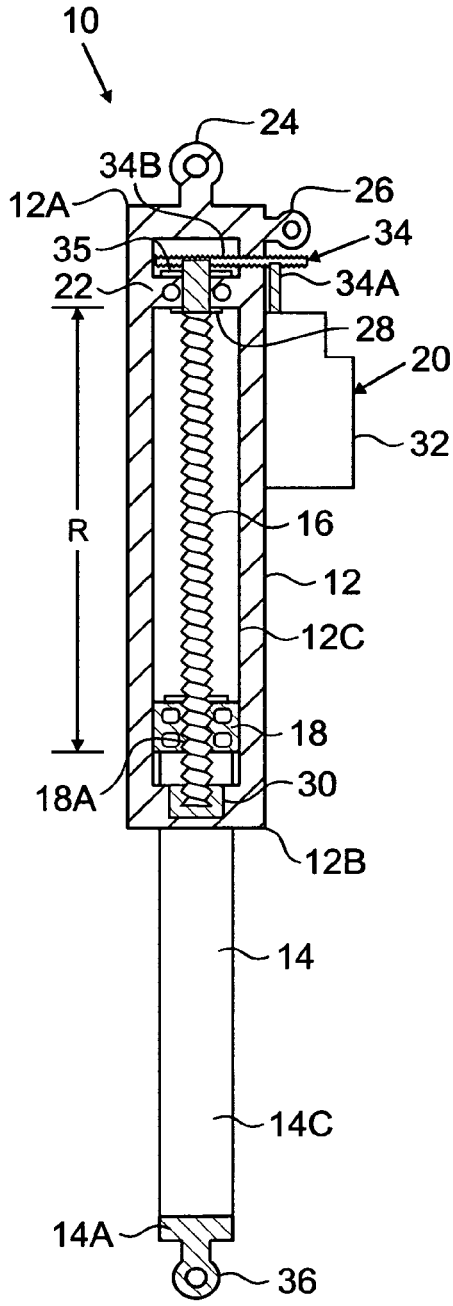
FIG. 2 is a cross sectional view of the adjustable link assembly of FIG. 1, taken along line 2-2.

FIGS. 1 and 2 illustrate an adjustable link assembly 10. FIG. 1 is a side view of the adjustable link assembly, and FIG. 2 is a cross sectional view of the adjustable link assembly, taken along line 2-2 of FIG. 1. The adjustable link assembly 10 includes a frame 12, a lower frame member 14, a drive shaft 16, a slide block 18, and a motor assembly 20.

The frame 12 is an elongate structure of generally rectangular shape having an upper end 12A, a lower end 12B, and defining a central opening 12C. A lateral support 22 is located within the central opening 12C adjacent to the upper end 12A. An upper connection structure 24 extends from the upper end 12A of the frame 12, to enable pivotal bolted, pinned, etc. connections to the frame 12. A side connection structure 26 extends from the frame 12 at approximately 90° with respect to the upper connection structure 24, to enable an additional connection to the assembly 10. The frame 12 is generally made of a suitable metallic material (e.g., steel) to support desired loading of the adjustable link assembly 10.

The drive shaft 16 is positioned substantially within the central opening 12C of the frame 12. The drive shaft 16 is a threaded screw-type shaft that engages the slide block 18 in a driving relationship. The drive shaft 16 is rotatably supported at the lateral support 22 and the lower end 12B of the frame 12 by bearing sets 28 and 30, respectively. The bearing sets 28 and 30 are sealed ball bearing sets.

The slide block 18 has a threaded opening 18A that accepts the drive shaft 16 so that the respective threads mesh with each other. Rotation of the drive shaft 16 moves the slide block 18 within the central opening 12C of the frame 12 in a vertical direction. The direction of vertical movement relative to the rotation of the drive shaft will depend upon the orientation of the threads, which can vary as desired. The slide block 18 further engages the frame 12 at the sides of the central opening 12C in a sliding relationship. Movement of the slide block 18 occurs within a range R, which is generally defined between the lateral support 22 and the lower end 12B of the frame 12. In one embodiment, the range R is about 127 cm (50 inches). However, the size of range R can vary as desired for particular applications. It will be understood that the operation of the adjustable link assembly 10 to cause vertical adjustment with the threaded drive shaft 16 and slide block 18 is comparable to that of known screw jacks.

The motor assembly 20 is engaged with the drive shaft 16, to selectively rotate the shaft 16 and move the slide block 18. The motor assembly 20 includes an electric motor 32 (shown only in schematic form in FIG. 2 for simplicity) and gearing 34 to mechanically link the electric motor 32 and the drive shaft 16, such as through toothed gears 34A and a drive chain 34B or other suitable mechanisms. In the illustrated embodiment, the gearing 34 includes a gear reduction subassembly mechanically connected between the drive shaft 16 and the electric motor 32. The electric motor 32 includes a radio frequency (RF) receiver to enable control via a conventional RF remote control. The motor assembly 34 further includes a conventional brake 35 used to arrest rotation of the drive shaft 16. It should be noted that while in the illustrated embodiment the motor assembly 20 utilizes an electric motor 32, other types of motors can be used in alternative embodiments.

The lower frame member 14 is generally U-shaped, having a lower base portion 14A and a pair of legs 14B and 14C extending upwards therefrom. The lower frame member 14 is made of a metallic material (e.g., steel). A lower connection structure 36 extends from the base 14A of the lower support member 14, to enable making pivotal bolted, pinned, etc. connections for supporting items from the adjustable link assembly 10. The legs 14B and 14C of the lower frame member 14 are pivotally connected to the slide block 18 using pin-like members 38. This causes the lower frame member 14 to move vertically with the slide block 18 when the slide block 18 is driven to move by rotation of the drive shaft 16. Components of the adjustable link assembly 10 are generally kept in tension, which helps maintain engagement of the threads of the drive shaft 16 and the slide block 18.

Figure 3:
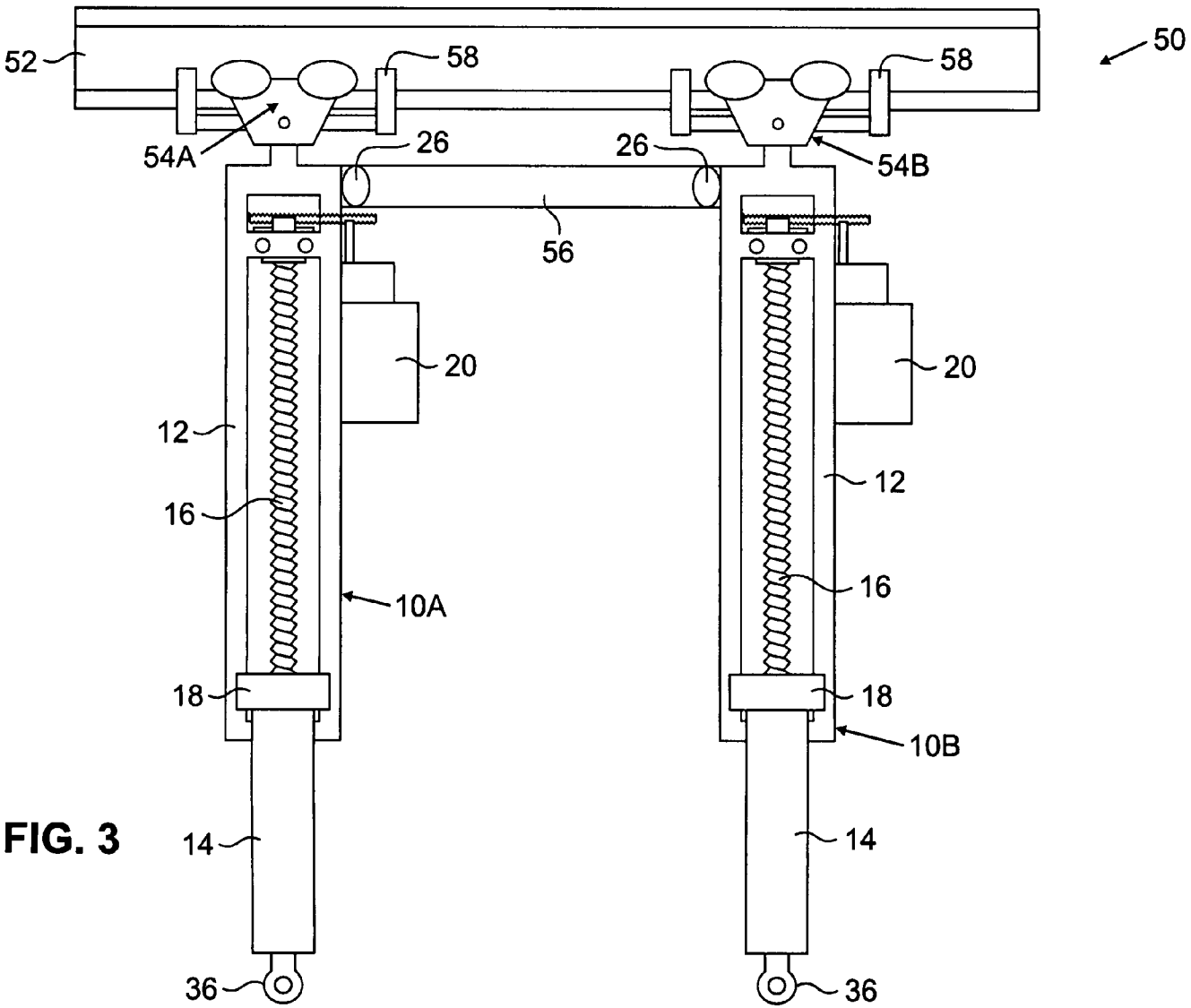
FIG. 3 is a side view of a monorail support system utilizing two of the adjustable link assemblies of FIGS. 1 and 2.

FIG. 3 is a side view of a monorail support system 50 that includes an overhead monorail track 52, two adjustable link assemblies 10A and 10B supported by trolleys 54A and 54B, respectively, and a lateral connecting link 56. The adjustable link assemblies 10A and 10B are each similar to those described above with respect to FIGS. 1 and 2.

The monorail track 52 is of a conventional type used in gas turbine engine assembly facilities. It is positioned generally overhead, near a ceiling of the facility in which it is installed. The trolleys 54A and 54B are attached to the track 52, and include safety catch structures 58. The operation of monorail and trolley systems used for engine assembly is well known to those of ordinary skill in the art. It is possible to configure the system 50 such that the adjustable link assemblies 10A and 10B connect to existing monorail tracks and trolleys, that is, so that the adjustable link assemblies of the present invention replace existing cable hoist systems connected to the monorail tracks and trolleys.

The adjustable link assemblies 10A and 10B are suspended from the trolleys 54A and 54B, respectively, below the monorail track 52. The trolleys 54A and 54B are bolted to the upper connection structures 24 of the adjustable link assemblies 10A and 10B. The lateral connecting link 56 is a beam connected between the side connection structures 26 of the adjustable link assemblies 10A and 10B, which forces both link assemblies 10A and 10B and their respective trolleys 54A and 54B to move together along the monorail track 52. Typically, two adjustable link assemblies are used to support a single gas turbine engine during assembly, which makes it desirable to connect those adjustable link assemblies so they move together. Furthermore, the adjustable link assemblies 10A and 10B are typically vertically adjusted together. For example, where the assemblies 10A and 10B can be adjusted by remote control, an operator can use a single remote control to control vertical adjustments of both assemblies 10A and 10B simultaneously. Although use of the lateral connecting link 56 and use of a common remote control scheme are each optional.

Figure 4:
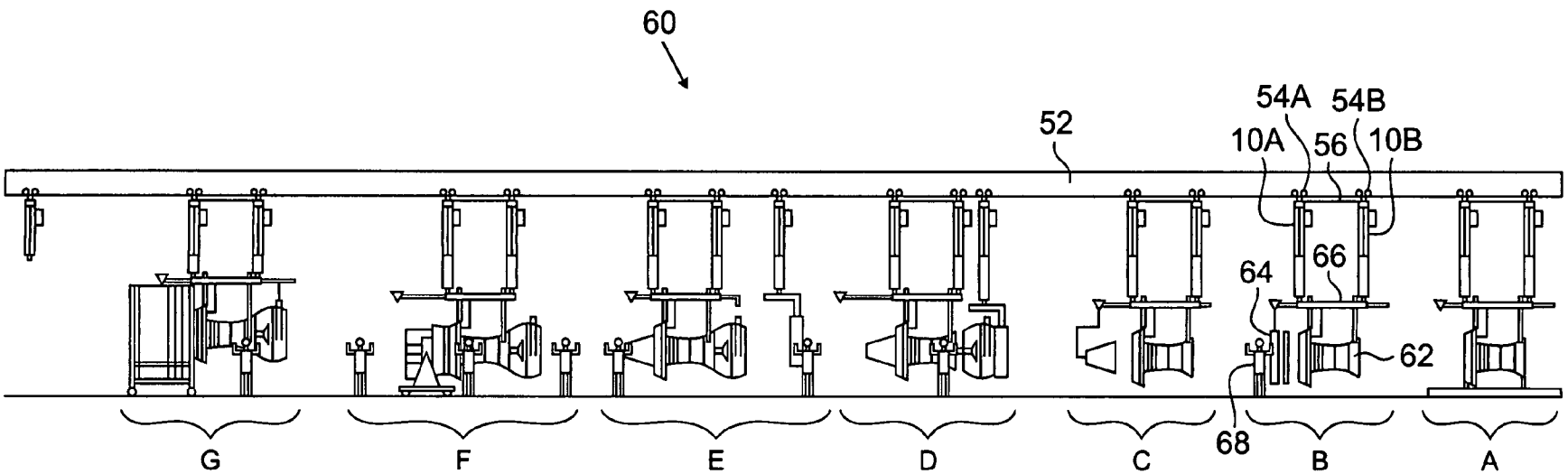
FIG. 4 is a schematic side view of an assembly line utilizing the adjustable link assemblies of FIGS. 1-3.

FIG. 4 is a schematic side view of an assembly line 60 having stations A-G. The stations A-G represent different stages of the assembly process used in fabricating gas turbine engines. The stations A-G are illustrated as different locations along the monorail track 52. At station A, an engine core 62 is delivered to the assembly line 60. At stations B-G engine modules are connected to the engine core 62 and various assembly operations are performed. For instance, at station B, a first module 64 is connected to the engine core 62. Assembly of the gas turbine engine is completed at station G.

As shown at station B (reference numbers at other stations are omitted for simplicity), a build beam assembly 66 is supported by the adjustable link assemblies 10A and 10B and their respective trolleys 54A and 54B from the monorail track 52. The build beam assembly 66 provides a direct connection to the engine components (e.g., the engine core 62), and can include hoists or other auxiliary lifts for supporting engine modules (e.g., the first module 64) and tooling. One example of a suitable build beam assembly 66 is described in co-pending U.S. patent application Ser. No. 11/500,682, filed on even date herewith, which is hereby incorporated by reference in its entirety. The auxiliary lifts of the build beam assembly 66 are used to lift relatively lightweight items (less than about 272 kg or 600 lbs and most commonly less than about 45 kg or 100 lbs.). The adjustable link assemblies 10A and 10B are controlled by an operator 68, who can control the vertical position of workpieces to better perform assembly operations, to better connect engine modules, and to perform other adjustments to facilitate assembly. One such way adjustment can be helpful is to position the engine (i.e., the workpiece) at a height suited to the particular operator. Another way adjustment can be helpful is to initially lift the engine core 62 off of the ground or off of a platform at station A, while permitting adjustment of the vertical position of the engine core 62 (and associated modules and components) at subsequent stations without having to set the engine core 62 or other components back down on the ground or onto a platform.

Although the present invention has been described with reference to preferred embodiments, workers skilled in the art will recognize that changes may be made in form and detail without departing from the spirit and scope of the invention. For instance, the particular size and shape of an adjustable link assembly according to the present invention can vary as desired for particular applications. Moreover, one or more safety catch assemblies, such as spring-loaded sleeved catches similar to known safety catches for automotive jack screw lifts, can be included with an adjustable link assembly according to the present invention.

What is claimed is:

1. An adjustable link assembly comprising:

an elongate frame member having a first connection structure at an upper end thereof and a central opening that passes between opposite sides of the elongate frame member;

a threaded drive shaft defining opposite first and second ends, the threaded drive shaft positioned in the central opening of the elongate frame member and rotatably connected to the elongate frame member at both the first and second ends;

a motor operably connected to the threaded drive shaft to enable rotation of the threaded drive shaft;

a slide block operatively engaged to in a sliding relationship with the elongate frame member and operatively engaged in a driving relationship with the threaded drive shaft, wherein rotation of the threaded drive shaft drives sliding movement of the slide block with respect to the elongate frame member; and a clevis-shaped lower frame member pivotally connected to the slide block at opposite sides of the elongate frame member through the central opening, wherein the lower frame member has a base portion and two leg portions extending from the base portion, wherein the lower frame member has a second connection structure at a lower end thereof, and wherein the lower frame member is configured such that at least a portion of the lower frame member surrounds at least a portion of the elongate frame member while still permitting pivotal movement between the elongate frame member and the lower frame member.

2. The assembly of claim 1 and further comprising:

a gear reduction assembly operably connected between the threaded drive shaft and the motor.

3. The assembly of claim 1 and further comprising:

a brake assembly operably connected to the threaded drive shaft for arresting rotation of the threaded drive shaft.

4. The assembly of claim 1 and further comprising:

a plurality of bearings for rotatably connecting the threaded drive shaft to the elongate frame member.

5. The assembly of claim 4, wherein the bearings are all sealed.

6. The assembly of claim 1, wherein the slide block is movable though a range of about 127 cm (50 inches) relative to the threaded drive shaft.

7. The assembly of claim 1, wherein the motor is disposed adjacent to the elongate frame member.

8. The assembly of claim 1, wherein the motor is operable by remote control.

9. The assembly of claim 1, wherein the slide block forms a threaded opening that meshes with the threaded drive shaft.

10. The assembly of claim 1 and further comprising:

a trolley assembly connected to the first connection structure of the elongate frame member.

11. The assembly of claim 10 and further comprising:

a monorail track, wherein the trolley assembly is suspended from the monorail track.

12. An adjustable tensile link assembly comprising:

a first frame member having an elongate shape and a central opening, the first frame member further having a first connection structure located at an upper end thereof, the central opening passing between opposite sides of the first frame member;

a drive shaft disposed at least partially within the central opening of the first frame member;

a slide block disposed substantially within the central opening of the first frame member, wherein the slide block is operatively engaged in a sliding relationship with the first frame member, and wherein the slide block has a threaded opening that meshes in a driving relationship with the threaded drive shaft, wherein rotation of the threaded drive shaft induces sliding movement of the slide block with respect to the first frame member; and a clevis-shaped second frame member having a base portion and two leg portions extending from the base portion, wherein the two leg portions are both pivotally connected to the slide block at opposite sides of the first frame member through the central opening, wherein the second frame member has a second connection structure at located at the base portion, and wherein the second frame member is configured such that each of the two leg portions of the second frame member at least partially surround a portion of the first frame member without obstructing pivotal movement between the first frame member and the second frame member.

13. The assembly of claim 12 and further comprising:

a motor operably connected to the drive shaft and enabling rotation of the threaded drive shaft.

14. The assembly of claim 12, wherein the motor is disposed adjacent to an exterior side of the first frame member.

15. The assembly of claim 12, wherein the motor is operable by remote control.

16. The assembly of claim 12 and further comprising:

a gear reduction assembly operably connected between the drive shaft and the electric motor.

17. The assembly of claim 12 and further comprising:

a brake assembly operably connected to the drive shaft for arresting rotation of the drive shaft.

18. The assembly of claim 12 and further comprising:

a plurality of bearings for rotatably securing opposite ends of the threaded drive shaft within the central opening of the first frame member.

19. The assembly of claim 18, wherein the bearings are all sealed.

20. The assembly of claim 12, wherein the slide block is movable through a range of about 127 cm (50 inches) relative to the threaded drive shaft.

* * * * *

UNITED STATES PATENT AND TRADEMARK OFFICE

CERTIFICATE OF CORRECTION

PATENT NO. : 7,559,280 B2
APPLICATION NO. : 11/500681
DATED : July 14, 2009
INVENTOR(S) : Amir M. Kalantari It is certified that error appears in the above-identified patent and that said Letters Patent is hereby corrected as shown below:

Column 5, Line 2 delete "though", insert --through--

Signed and Sealed this

Thirteenth Day of July, 2010

David J. Kappos

David J. Kappos
*Director of the United States Patent and Trademark Office*